US009074746B2

(12) United States Patent
Rice et al.

(10) Patent No.: US 9,074,746 B2
(45) Date of Patent: Jul. 7, 2015

(54) NON-UNIFORM MULTI-FACETED REFLECTOR FOR REAR COMBINATION LAMP PROVIDING SPARKLE EFFECT

(75) Inventors: Lawrence M. Rice, Hillsboro, NH (US); Sharon L. Ernest, Concord, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 64 days.

(21) Appl. No.: 13/591,923

(22) Filed: Aug. 22, 2012

(65) Prior Publication Data

US 2014/0056008 A1 Feb. 27, 2014

(51) Int. Cl.
*F21V 7/00* (2006.01)
*F21S 8/10* (2006.01)

(52) U.S. Cl.
CPC ..... *F21S 48/215* (2013.01); *F21S 48/234* (2013.01)

(58) Field of Classification Search
CPC . F21S 48/1317; F21S 48/1376; F21S 48/215; F21S 48/234
USPC ..... 362/516–519, 346, 297, 487, 460, 348
See application file for complete search history.

(56) References Cited

U.S. PATENT DOCUMENTS

| | | | | |
|---|---|---|---|---|
| 3,700,883 | A * | 10/1972 | Donohue et al. | 362/518 |
| 4,704,661 | A * | 11/1987 | Kosmatka | 362/518 |
| 6,053,623 | A * | 4/2000 | Jones et al. | 362/310 |
| 6,474,845 | B1 * | 11/2002 | Mabe et al. | 362/296.04 |
| 7,042,165 | B2 * | 5/2006 | Madhani et al. | 315/185 R |
| 7,075,224 | B2 * | 7/2006 | Coushaine | 313/498 |
| 7,212,347 | B2 * | 5/2007 | Pentico et al. | 359/625 |
| 7,722,210 | B2 * | 5/2010 | Tessnow et al. | 362/211 |
| 7,905,639 | B2 * | 3/2011 | Luo et al. | 362/487 |
| 2011/0032721 | A1 * | 2/2011 | Koizumi et al. | 362/519 |
| 2013/0182457 | A1 * | 7/2013 | McCollum | 362/612 |

* cited by examiner

*Primary Examiner* — Jason Moon Han
(74) *Attorney, Agent, or Firm* — Edward S. Podszus

(57) ABSTRACT

A rear combination lamp for a vehicle is disclosed, in which facets on a reflective surface impart relatively large angular deviations to their respective reflected beams. Reflected light from each facet is only visible over a particular angular range. The angular ranges for all facets overlap only in a predetermined manner, so that at a given viewing angle, light from only particular facets is visible. The appearance of the rear combination lamp varies as a function of viewing direction. As a viewing angle changes, light from certain facets becomes visible, and light from other facets becomes invisible. This changing subset of which facet reflections are visible produces a sparkling or twinkling effect from the rear combination lamp. In some designs, the sparkling can take on a pattern that moves across the rear combination lamp, as the viewing angle changes.

14 Claims, 6 Drawing Sheets

NON-UNIFORM MULTI-FACETED REFLECTOR FOR REAR COMBINATION LAMP PROVIDING SPARKLE EFFECT

TECHNICAL FIELD

The present disclosure relates to rear combination lamps for automotive lighting systems.

BACKGROUND

For many years, automobiles have employed electric lighting that serves a variety of functions. For instance, lights provide forward illumination (headlamps, auxiliary lamps), conspicuity (parking lights in front, taillights in rear), signaling (turn signals, hazards, brake lights, reversing lights), and convenience (dome lights, dashboard lighting), to name only a few applications. In recent years, light emitting diodes (LEDs) have become common in some of the lighting applications for automobiles. Compared with older incandescent bulbs, LEDs use less power, last longer, and have less heat output, making them well suited for automotive applications.

In general, for each known rear combination lamp, the appearance of the lamp is generally the same for all viewing angles.

SUMMARY

An embodiment is a rear lamp reflector. The rear lamp reflector includes a plurality of reflective facets that reflect light emitted by a light source toward a viewer. The reflected light is viewable over a range of viewing angles. The facets are angled so that at first and second viewing angles, light propagates to the viewer only from respective first and second subsets of facets from the plurality. At least two of the facets in the first subset are non-contiguous. At least two of the facets in the second subset are non-contiguous. The first and second subsets are mutually exclusive.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

A rear combination lamp for a vehicle is disclosed, in which facets on a reflective surface impart relatively large angular deviations to their respective reflected beams.

Reflected light from each facet is only visible over a particular angular range. The angular ranges for all facets overlap only in a predetermined manner, so that at a given viewing angle, light from only particular facets is visible. The appearance of the rear combination lamp varies as a function of viewing direction. As a viewing angle changes, light from certain facets becomes visible, and light from other facets becomes invisible. This changing subset of which facet reflections are visible produces a sparkling or twinkling effect from the rear combination lamp. In some designs, the sparkling can take on a pattern that moves across the rear combination lamp, as the viewing angle changes.

The above paragraph is merely a generalization of several of the elements and features described in detail below, and should not be construed as limiting in any way. Next, we provide a discussion of the optical path in the rear combination lamp, followed by a more detailed discussion of an example mechanical implementation of the optical components.

Figure 1:
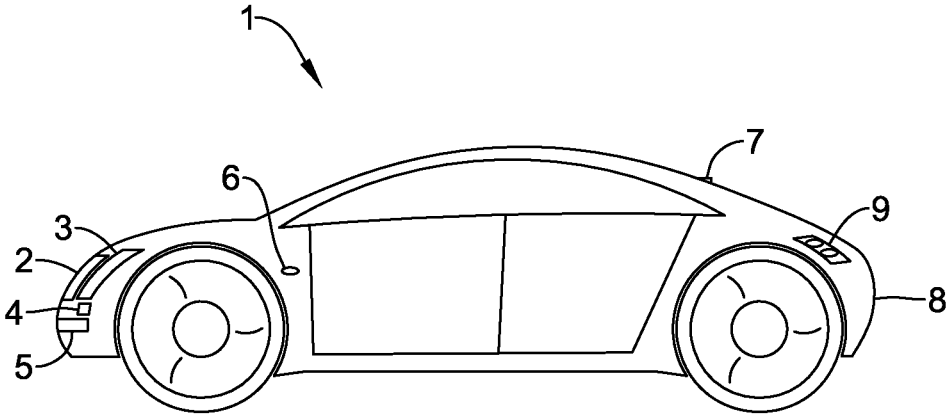
Figure 1 Prior Art
FIG. 1 is a schematic drawing of the example external lighting of a known automobile.

FIG. 1 shows a typical, known automobile 1, with typical exterior lights that include front turn indicators 2, headlamps 3, fog lamps 4, side repeaters 6, a center high mounted stop lamp 7, a license plate lamp 8, and so-called "rear combination lamps" 9 (RCLs). Any or all of these may include accessories, such as a headlamp cleaning system 5. We concentrate primarily on the rear combination lamps 9 for this application. Note that FIG. 1 is reproduced from FIG. 1 of U.S. Pat. No. 7,905,639, titled "Side-loaded light emitting diode module for automotive rear combination lamps", issued on Mar. 15, 2011 to Luo et al., and assigned to Osram Sylvania Inc. of Danvers, Mass.

Note that each rear combination lamp 9 may include a tail light (also known as a marker light), a stop light (also known as a brake light), a turn signal light, and a back up light. Each light in the rear combination lamp 9 may have its own light source, its own reflection and/or focusing and/or collimation and/or diffusing optics, its own mechanical housing, its own electrical circuitry, and so forth. In this respect, an aspect or feature of one particular light may be used for any or all of the lights in the rear combination lamp 9. Optionally, one or more functions may be shared among lights, such a circuit that controls more than one light source, or a mechanical housing that holds more than one light source, and so forth. For instance, each lighting sub-system typically has its own independent lamp, although the tail light and stop light functions may be combined in a single lamp (bulb) having a double filament.

In general, there are four key elements for an LED-based lighting module: (1) the actual LED chip or die, (2) the heat sink or thermal management, which dissipates the heat generated by the LED chip, (3) the driver circuitry that powers the LED chip, and (4) the optics that receives the light emitted by the LED chip and directs it toward a viewer. These four elements need not be redesigned from scratch for each particular module; instead, a particular lighting module may use one or more elements that are already known. The following reference describes several of these known elements, which may be used with the LED-based lighting module disclosed herein.

U.S. Pat. No. 7,905,639, titled "Side-loaded light emitting diode module for automotive rear combination lamps", issued to Luo et al., and assigned to Osram Sylvania Inc. of Danvers, Mass., discloses various mechanical, electrical and thermal aspects of a rear combination lamp, plus various optical geometries for a rear combination lamp, and is incorporated by reference herein in its entirety. In particular, the reflector disclosed in '639 is parabolic and faceted, where the facets are used to angularly broaden the output beam. The geometries and mechanical, electrical and thermal aspects disclosed by '639 may be used directly or may easily be modified for the light module disclosed herein.

Note that with most or all known faceted reflectors, the facets are used to provide generally small angular deviations to the reflected light, in order to angularly broaden a reflected light distribution. In particular, the appearance of each of these rear combination lamps is relatively constant as a function of viewing angle. For instance, the relatively bright and dark portions of the exiting light distribution appear relatively bright and dark when viewed end-on, and also when viewed from off to the side. Changing the viewing angle for these designs does not significantly change the appearance of the light distribution.

In contrast, for the presently disclosed device, the appearance of the light distribution does change as a function of viewing angle. For example, the rear combination lamp may look different for viewers directly behind the vehicle and off to the side of the vehicle. Additionally, the look of the lamp may change as the vehicle is driven by the viewer.

Figure 2:
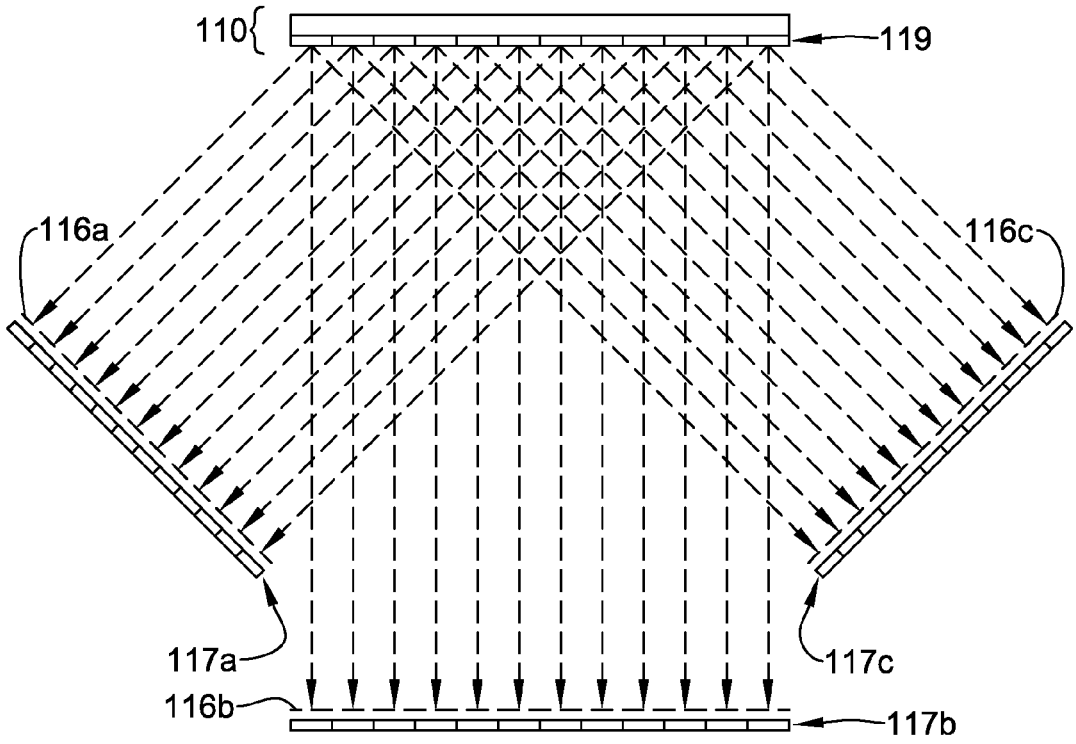
Figure 2 Prior Art
FIG. 2 is a cross-sectional schematic drawing of the light output from a known rear combination lamp.

FIG. 2 is a cross-sectional schematic drawing of the light output from a known rear combination lamp 110. For simplicity, the lamp 110 is drawn as a rectangle in FIG. 2.

In the interior of the rear combination lamp 110, a light source illuminates a reflector, and the reflected light exits through a transparent cover toward a viewer. The surface area of the reflector is divided into various regions 119 across its surface area. Although FIG. 2 shows only twelve regions 119, all arranged along a line, it will be understood that the actual reflector is two-dimensional and has a two-dimensional array or grid of regions 119. In particular, the regions 119 may correspond to facets in the reflector, where each facet may impart a predetermined angular deviation to the reflected beam.

FIG. 2 attempts to show this invariance with respect to viewing angle. For each region 119 or facet, there is a particular angular distribution of light exiting the lamp 110. While a true lamp 110 would have a continuous angular distribution, for the purposes of demonstration, only three angular positions are shown in FIG. 2, including a "left" position, a "center" position and a "right" position.

In the known designs represented by FIG. 2, light from all twelve regions 119 or facets propagates to all three angular positions. Elements 116A, 116B and 116C are intended to represent output beams from the lamp 110. A viewer that looks at the lamp from positions near elements 116A, 116B and 116C would see respective light distributions 117A, 117B and 117C. The light distributions 117A, 117B and 117C for the known lamp 110 look essentially the same for all three positions. Note that the delimiters between the twelve positions in elements 119, 117A, 117B and 117C are shown as being solid lines only for convenience.

Figure 3:
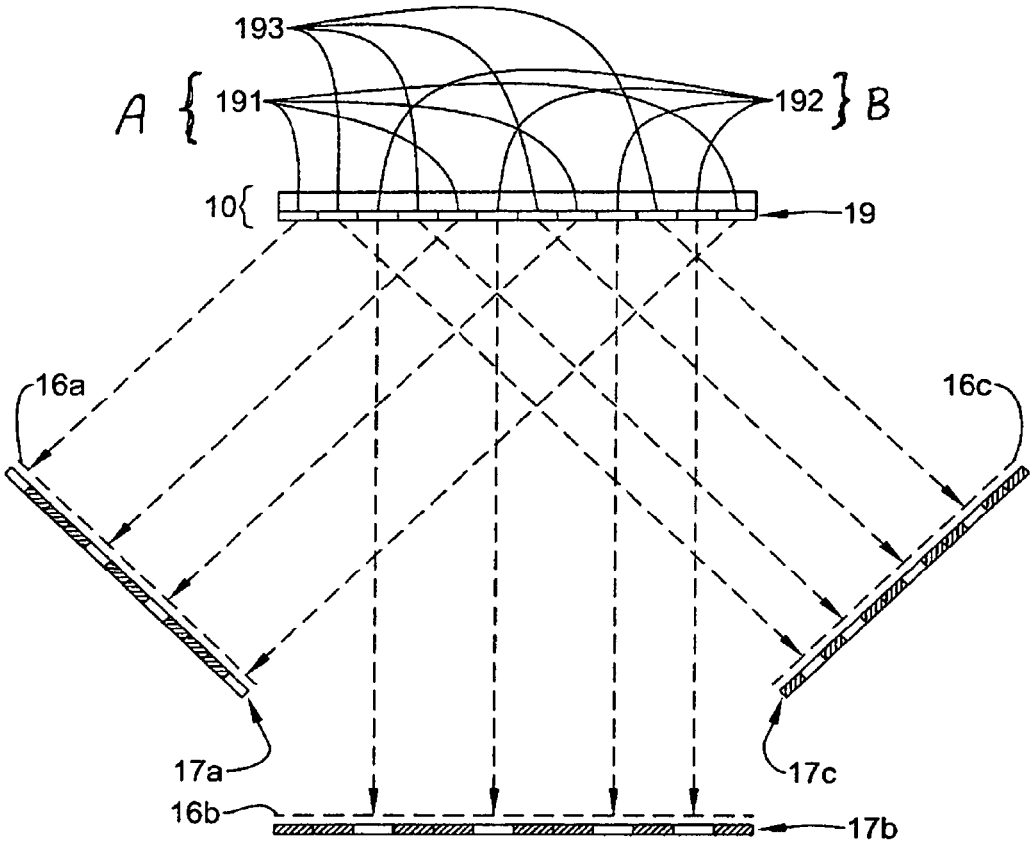
FIG. 3 is a cross-sectional schematic drawing of the light output from an example rear combination lamp.

In contrast with the known designs of FIG. 2, the light output from the present design more closely resembles that of FIG. 3.

For the rear combination lamp 10, shown schematically as a rectangle, light from each of the twelve facets 19 has a strong directional dependence. The various facets 19 direct light strongly into only particular, predetermined angles or angular ranges, with the predetermined angles varying strongly from facet-to-facet.

As with FIG. 2, the output beams 16A, 16B and 16C are shown as propagating in one of only three example directions. In practice, the output from the facets can propagate into a continuum of angles and angular ranges, without confinement to the three directions shown in FIGS. 2 and 3.

Viewers looking at the rear combination lamp 10 would see light distributions 17A, 17B and 17C near the positions of 16A, 16B and 16C, respectively, arriving from reflections off facets 191, 192 and 193, respectively. Note that the distributions look different at each of the three positions. A bright spot in one of the distributions appears dark in the other two distributions.

Because the lamp 10 has an output with such a strong angular dependence, the lamp 10 may have a unique appearance, unlike the known lamp 110. To a driver in an adjacent lane, or a viewer off to a side of the driving path, as the vehicle changes position, the viewing angle may change, and the lamp 10 may take on a "twinkling" or "sparkling" appearance as light from particular facets becomes visible while light from other facets becomes invisible.

This twinkling or sparkling may be an advantage over the known lamps, in that that the twinkling or sparkling may catch the eye of a relatively inattentive driver, who might otherwise not see a common, non-sparkling lamp in his or her peripheral vision. Another advantage is that such a lamp 10 may be readily associated with a particular make or model of vehicle, and may serve to increase brand awareness of the vehicle.

Figure 4:
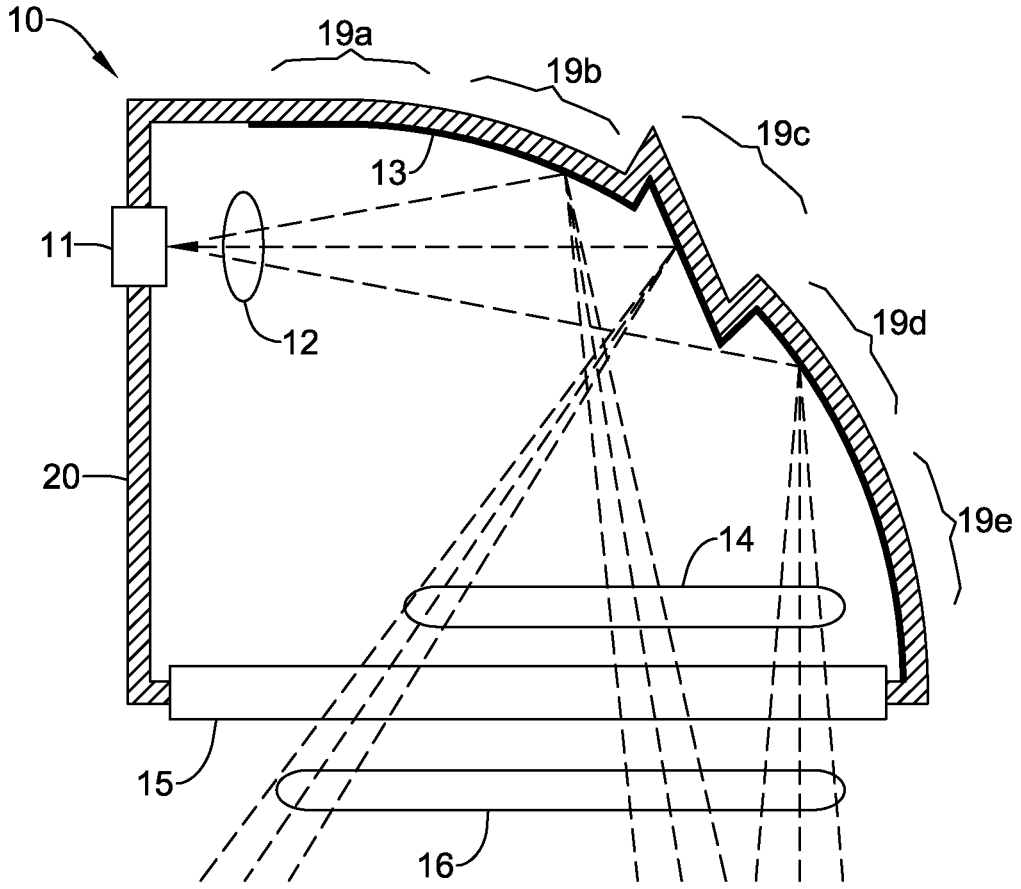
FIG. 4 is a cross-sectional schematic drawing of a simplified optical path in a rear combination lamp, having a single LED and a faceted reflector.

FIG. 4 is a cross-sectional schematic drawing of a simplified example optical path in a rear combination lamp 10. Note that FIG. 4 is modified from FIG. 4 of U.S. Pat. No. 7,905,639, titled "Side-loaded light emitting diode module for automotive rear combination lamps", issued on Mar. 15, 2011 to Luo et al., and assigned to Osram Sylvania Inc. of Danvers, Mass. In particular, the angular orientations of the facets differ from those shown in the '639 patent, and the reflecting surface that includes these facets therefore also differs.

An LED module 11 emits a diverging beam 12 laterally, toward the side of the rear combination lamp 10. In this optical path, there is only a single LED in the LED module 11, although in practice, there may be more than one LED in the module.

The diverging beam 12 strikes a reflector 13, which collimates the beam and reflects a collimated beam 14 longitudinally, toward the front of the rear combination lamp 10.

In practice, it may be desirable to have the exiting beam be slightly converging or slightly diverging, in order to subtend a larger angular range. For these cases, we may say that the exiting beam may be "generally" collimated.

The reflector 13 may have the base shape of a paraboloid, which is parabolic in a cross-section that includes its vertex. It is known that parabolic reflectors form a virtually aberration-free collimated beam from a light source placed at the focus of the paraboloid. Longitudinal shifting of the source away from the focus may produce defocus, or deviation away from collimation, or, equivalently, deviation of the light flux away from parallelism. Lateral shifting of the source away from the focus may produce a pointing error of the reflected collimated beam. In other words, for a laterally shifted source, the reflected beam is still collimated, but the reflected beam may angularly deviate from the un-shifted case. In general, the value of such an angular shift, in radians, equals the lateral shift of the source, divided by the focal length of the parabolic reflector. For large enough lateral shifts away from the focus, the reflected beam may also exhibit monochromatic wavefront aberrations, such as coma.

For an old-style reflector that used incandescent bulbs, the bulb was typically placed at the focus of a parabolic reflector, symmetrically, from the back of the reflector. The reflector typically surrounded the bulb, with an opening toward the front of the fixture. Because an incandescent bulb radiated light into all directions (except toward the socket), it was useful to surround the bulb azimuthally, so that as much radiated light as possible was directed into the collimated beam emerging from the parabolic reflector.

In contrast, for parabolic reflectors that use LEDs as their light sources, it is not necessary to use the full, 360-degree azimuthally-complete paraboloid to capture all the light radiated from the source. Because LEDs radiate into a relatively small solid-angle cone, compared with incandescent bulbs, one need only use a portion of the paraboloid that the sufficiently captures the full spatial extent of the beam at the reflector. As a result, the base shape of the reflector 13 may be a fraction of a paraboloid, such as a half-paraboloid, or other suitable paraboloid portion. Note that a half-paraboloid may be visualized by bisecting the full paraboloid by a plane that extends through its vertex and its focus. Optically, such a fraction of a paraboloid works sufficiently well to capture the diverging light from the source, and uses less volume and less material than a full paraboloid would.

The collimated or generally collimated beam 14 may be commonly referred to in the literature as "parallel light flux". These terms are interchangeable, and may be considered equivalent as used in this application.

After passing through a transparent or translucent "clear cover" or "lens cover" 15, the collimated beam 14 remains collimated 16, and exits the rear combination lamp 10 at the rear of the automobile, toward the viewer. The clear cover 15 may have an optional spectral effect, such as filtering one or more wavelengths or wavelength bands from the transmitted light, but typically does not scatter the beam, as a diffuser would.

The LED module 11, the reflector 13, and the clear cover 15 may all be held mechanically by a housing 20. Such a housing 20 may be desirable in that it can be manufactured inexpensively, and may be molded or stamped to include the surface profile of the reflector 13. The mechanical aspects of the rear combination lamp 10 are discussed in much greater detail below, following the current description of the optical path.

The example design in FIG. 4 shows five facets 19A, 19B, 19C, 19D and 19E, each of which can angularly divert the reflected light from a nominal position in a predetermined manner. As used in FIG. 4, the facets 19A-E do not merely widen or angularly broaden the overall output light distribution, but instead divert portions of the beam angularly outward in a largely non-overlapping manner. As the vehicle moves with respect to a viewer, light from particular facets becomes visible, and light from other facets becomes invisible, with the viewer seeing light from facets changing in a predetermined manner. This may produce a sparkling effect for the viewer.

As used in the rear combination lamp 10 of FIG. 4, the faceted reflector 13 receives the diverging beam 12 from the LED module 11, generally collimates the beam and angularly diverts portions of the beam, and directs the generally collimated and angularly diverted beam 14 to the clear cover 15, through which it exits the lamp 10.

We summarize the example optical path in the lamp 10 of FIG. 4 before discussing an example mechanical package for the lamp. An LED module 11 is placed at or near the focus of a faceted parabolic reflector 13. The LED module 11 is oriented to direct its diverging light output largely laterally. The diverging beam 12 from the LED module 11 strikes the faceted parabolic reflector 13, so that the optical axis has about a 45 degree angle of incidence, and the reflected optical axis leaves the reflector at about a 45 degree angle of exitance. The incident optical axis is largely horizontal and lateral, and the reflected optical axis is largely longitudinal. The parabolic reflector 13 generally collimates the beam and reflects a generally collimated beam, and the facets produce a particular angular distribution to the reflected collimated beam 14. The reflected collimated beam 14 passes through the clear cover 15 and becomes the exiting beam 16 that propagates toward a viewer.

Having summarized the optical path, we now discuss an example mechanical package of the rear combination lamp 10, which holds the optical components in place, delivers electrical power to the LEDs, and dissipates heat produced by the LEDs. One will appreciate that this is merely an example, and that other suitable mechanical packages may also be used.

Figure 5:
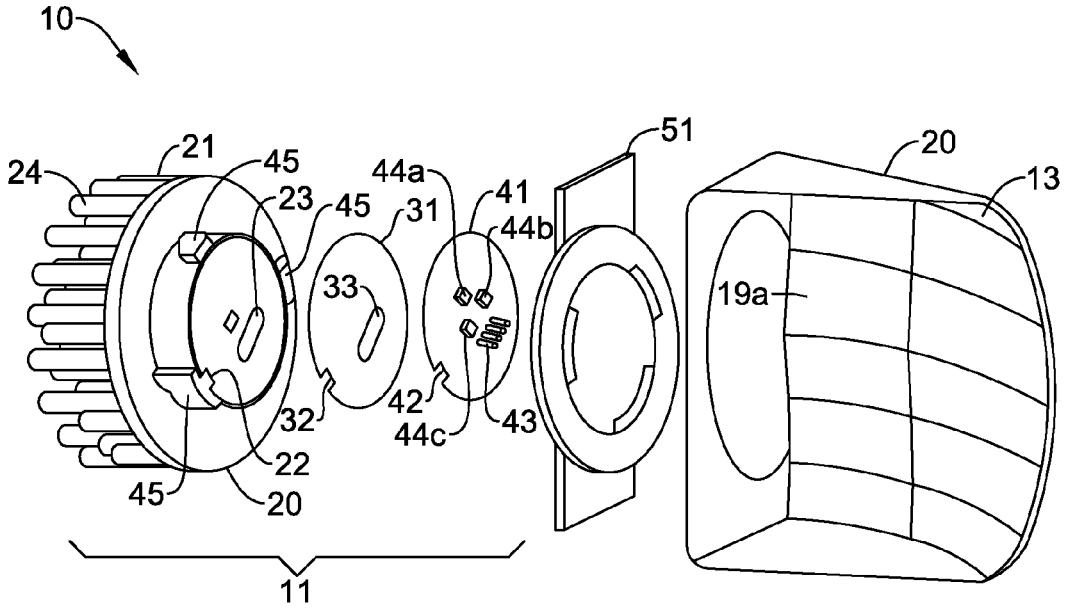
FIG. 5 is an exploded view schematic drawing of an example mechanical layout of a rear combination lamp.

The specific mechanical package disclosed in FIG. 5 is modified from FIG. 5 of U.S. Pat. No. 7,905,639, titled "Side-loaded light emitting diode module for automotive rear combination lamps", issued on Mar. 15, 2011 to Luo et al., and assigned to Osram Sylvania Inc. of Danvers, Mass.

Specifically, all the elements in the present FIG. 5 are identical to those shown in FIG. 5 of '639, except that the angular orientations of the facets 19*a* differ from those shown in the '639 patent. Consequently, the reflecting surface 13 that includes these facets 19*a* and the housing 20 that includes the reflecting surface 13 therefore also differ, but only in the shape of the facets 19*a* and the reflecting surface 13. The construction of the all the elements in FIG. 5 and the method of assembly may be essentially the same as in '639.

FIG. 5 is an exploded view schematic drawing of an example mechanical layout of a rear combination lamp 10. The following discussion of the elements of FIG. 5 is taken from the '639 patent noted above.

The light emitting diodes 44A, 44B and 44C are mounted on one side of the printed circuit board 41, so that they all emit in generally the same direction, perpendicular to the plane of the circuit board. In general, it is typical to try and mount the LEDs so that their emissions are truly parallel, but in practice there may be some small variations in the LED pointing angles due to component, manufacturing and assembly tolerances. In general, these small LED pointing errors do not create problems for the lamp 10.

The circuit board 41 includes the electrical circuitry that drives the LEDs 44A, 44B and 44C. The circuitry may be formed in a known manner, using techniques that are commonly applied to printed circuit boards. The LED driver circuit design may be a known design, such as, for example, the design from the reference cited above, U.S. Pat. No. 7,042,165, titled "Driver circuit for LED vehicle lamp", issued to Madhani et al., and assigned to Osram Sylvania Inc. of Danvers, Mass., which is incorporated by reference herein in its entirety. Alternatively, any suitable LED driver circuit may be used.

Although three LEDs are shown in FIG. 5, any suitable number of LEDs may be used, including one, two, three, four, five, eight, or any other suitable value. In general, the placement of the LEDs on the circuit board is determined by a compromise between optimizing the optical performance, which tends to group the LEDs as closely as possible, and optimizing the heat dissipation, which tends to spread the LEDs as far apart as possible.

The shape, or "footprint", of the printed circuit board 41 may be chosen arbitrarily. In the example design of FIG. 5, the footprint is round, or circular. A circular printed circuit board may be convenient for mounting into other components that have general cylindrical symmetry, such as the example heat sink 21 of FIG. 5. Alternatively, the printed circuit board may be square or rectangular in profile; a rectangular footprint may be conducive to reducing any wasted circuit board material during the manufacturing process. In general, any suitable shape may be used for the printed circuit board 41.

The electrical connections to and from the printed circuit board are made through one or more electrical connectors 43. Connectors such as these are convenient for quickly engaging or disengaging the circuit board. The connector 43 may be a known connector, such as those disclosed in the following two references: U.S. Pat. No. 7,110,656, titled "LED bulb", issued to Coushaine et al., and assigned to Osram Sylvania Inc. of Danvers, Mass., discloses a complementary socket and electrical connector mechanical structure for LED-based lighting modules, and is incorporated by reference herein in its entirety. U.S. Pat. No. 7,075,224, titled "Light emitting diode bulb connector including tension receiver", issued to Coushaine et al., and assigned to Osram Sylvania Inc. of Danvers, Mass., discloses another complementary socket and electrical connector mechanical structure for LED-based lighting modules, and is incorporated by reference herein in its entirety. Alternatively, any suitable connector may be used.

The circuit board 41 includes a slot or tab 42 that can engage a tab or slot 22 on the heat sink 21, so that the circuit board 41 may be easily rotationally oriented and retainably screwed/riveted onto the heat sink 21. This method of attachment provides quick, reliable placement of the circuit board, and requires no additional components or assembly steps. Alternatively, the circuit board may be attached with glue, a curable adhesive, screws, bolts, snaps, magnets, or any other suitable attachment method.

While it desirable to screw/rivet the printed circuit board 41 to the heat sink 21, so that the heat sink mechanically supports the circuit board in space, we ensure good thermal contact between the circuit board 41 and the heat sink 21 by inserting a thermal pad or "gap" pad and/or thermal grease 31 between the circuit board 41 and heat sink 21. The thermal pad 31 may have roughly the same footprint, or size and shape, as the printed circuit board 41 and may include its own tab 32 for orienting the pad rotationally with respect to the heat sink. The thermal pad may also be screwed while screwing the circuit board to the heat sink 21. In some applications, the thermal pad 31 snaps into the heat sink 21 using the same tab 22 on the heat sink; in other applications, it may use a separate tab. When the printed circuit board 41 snaps onto the heat sink 21, it secures in places the thermal pad 31.

The thermal pad 31 may include one or more holes 33 to accommodate the one or more electric connectors 43 on the printed circuit board 41.

In some applications, the thermal pad 31 has roughly the same footprint, or outer size and shape, as the printed circuit board 41. In other applications, the thermal pad 31 may be slightly larger than the printed circuit board. In still other applications, the thermal pad 31 may be slightly smaller than the printed circuit board, and may extend outward only as far as the extent of the actual circuitry on the circuit board 41.

In some applications, the printed circuit board 41 or the heat sink 21 may be coated with an electrically insulating material, and the thermal pad 31 may be omitted.

The heat sink 21, which may be known as a "casting socket", may be made from a thermally conducting material, such as aluminum, although any suitable thermal conductor may be used. The heat sink 21 may include a tab or slot 22 that engages with corresponding tabs or slots 32 and 42 on the thermal pad 31 and printed circuit board 41, for securing the circuit board and thermal pad to the heat sink 21.

The heat sink 21 may have its own electrical connections, for connecting to connector 43 on the circuit board, or may have one or more holes 23 that can accommodate the connector 43.

The heat sink 21 may have optional fins 24 for dissipating heat generated by the LEDs 44A-C and the circuitry on the circuit board 41.

Alternatively, the heat sink may be a separate part from the casting socket, or an optional part with fins may be brought into contact with the casting socket during assembly of the lamp 10.

Taken together, the heat sink 21, the thermal pad 31 and the printed circuit board 41 correspond to the "LED module" 11 from FIG. 4.

Once the thermal pad 31 and printed circuit board 41 are attached to the heat sink 21, the LED module 11 may be attached to an adapter 51, which in turn may be attached to a housing 20. Alternatively, the quarter turn adapter may be manufactured directly on the housing 20, so the LED module 11 can be pushed into the reflector and rotated a quarter turn to fix in position. The order of assembly of these components may be altered as suitable for the particular manufacturing process.

The housing 20 may be a single part that includes the curved and faceted surface of the reflector 13, which may optionally include additional reflective coatings on it, as well as adjacent flat surfaces for mounting and interfacing with additional components. The housing 20 includes a flat surface that is perpendicular to the cylindrical or longitudinal axis of the heat sink 21, which mechanically supports the adapter 51 and the LED module 11 when assembled.

The housing 20 may be made from any suitable material, such as metal, plastic, or any other suitable material or combination of materials.

The lamp 10 may also include a clear cover on its front face, which is not shown in the figures. Such a clear cover may optionally include one or more sealing features, to protect the other components from the elements.

Figure 6:
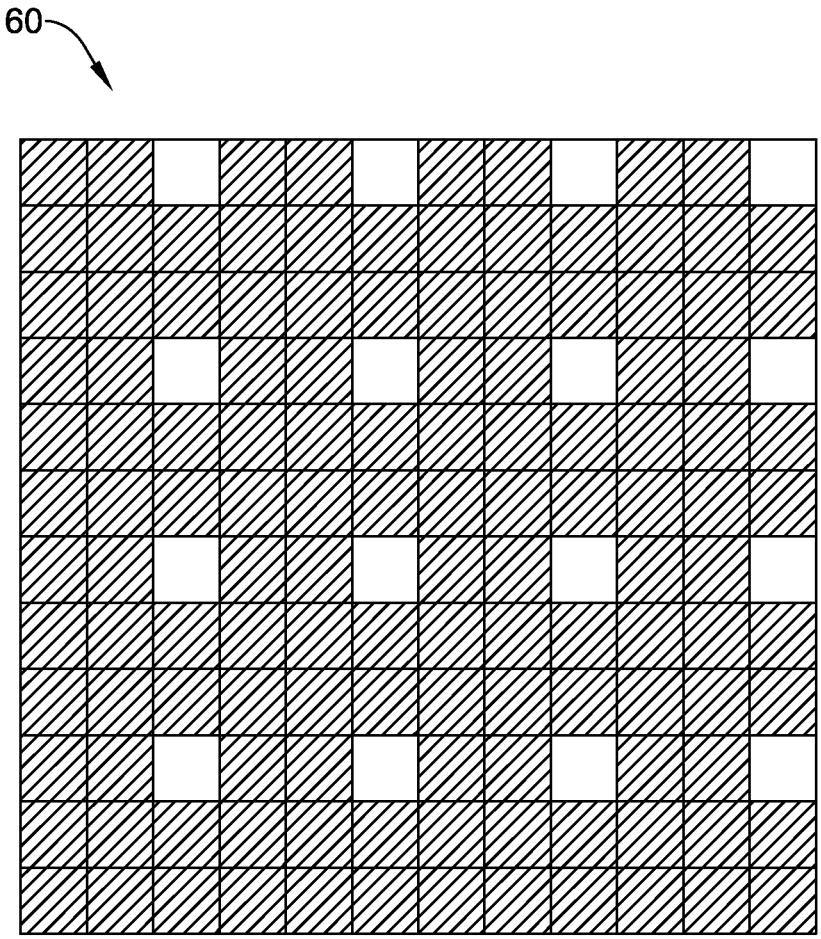
FIG. 6 is an end-on view of an example two-dimensional light distribution from a rear combination lamp.

Note that in the figures and discussion thus far, the facet angles and orientations have largely been confined to one plane for convenience. In practice, the facets are typically arranged in a two-dimensional area. FIG. 6 is an end-on view of an example two-dimensional light distribution 60. In this example, a bright facet is seen every third facet, in a pattern that repeats along both dimensions. As the viewing angle changes, the pattern can move, depending on the tilt orientations of the particular facets. In some cases, the pattern may move upward or downward; in other cases, the pattern may move laterally. In still other cases, the pattern may grow or shrink. It will be understood that the repeating pattern of FIG. 6 is just an example, and that any suitable pattern may produce the desired sparkling effect. The pattern may include vertical stripes, horizontal stripes, diagonal stripes, squares, rectangles, and other geometric shapes. It will also be understood that the desired effect may be a "random" twinkling, like a night sky, so that the pattern itself may appear as seemingly random but may actually be predetermined.

Note that as a practical matter, it may be more useful to have the "sparkling" effect as a function of horizontal angle (i.e. directly behind the vehicle versus in the next lane or off to the shoulder), rather than vertical angle (i.e., directly behind the vehicle versus raised up above the vehicle). It is relatively common, and relatively easy, for the horizontal viewing angle to change. For instance, a vehicle can drive by a stationary viewer, a vehicle can pass a slower vehicle, a viewer can walk by a stationary vehicle, and so forth. All of these examples change the horizontal viewing angle. There are far fewer instances when a vertical viewing angle changes, such as when a viewer climbs a flight of stairs next to a stationary vehicle. While there is nothing preventing taking advantage of such vertical effects in the "sparkle", it is probably more beneficial to make the "sparkle" effects largely, or possibly entirely, horizontal.

Finally, it is beneficial to describe the configuration of the facets 19 in more detail. In all cases, the facets 19 reflect light 12 emitted by a light source 11 toward a viewer, and the reflected light 16 is viewable over a range of viewing angles.

In most cases, the base curvature of the reflector 13 is a section of a paraboloid, with the light source 11 usually including an LED array at the focus of the paraboloid. The area of the reflector 13 is divided into particular regions, referred to herein as facets. Each facet has its own particular angular deviation from the base curvature, so that light reflecting off the facet still is collimated or is generally collimated, but has an angular deviation away from what would reflect from the base curvature itself. In some cases, the angular deviation is zero. The boundaries between adjacent facets may include relatively sharp edges or discontinuities in the reflector surface.

Specifically, the facets 19 are angled so that at first and second viewing angles, light 16 propagates to the viewer only from respective first and second subsets of facets from the total plurality of facets 19. At least two of the facets 19 in the first subset are non-contiguous. At least two of the facets 19 in the second subset are non-contiguous. The first and second subsets are mutually exclusive. Pictorially, an example of these subsets are shown in FIG. 3, where region "A" may represent a first subset of facets at a first viewing angle, and region "B" may represent a second subset of facets at a second viewing angle.

In some cases, as the viewing angle changes, light arrives at the viewer from a changing subset of facets 19 from the plurality, at least two facets at a time. In some cases, as the changing subset changes, the facets in the changing subset visually appear to change randomly. In other cases, as the changing subset changes, the facets in the subset visually appear to change in a pattern. In some of these cases, the pattern includes alternating facets in both horizontal and vertical dimensions.

In some cases, each facet is concave and is curved to collimate the light emitted by the light source. In other cases, each facet is concave and is curved to partially collimate the light emitted by the light source. Note that the term "partially collimate" is intended to include both the cases of slightly over-collimating the reflected light and slightly under-collimating the reflected light. Both of the "partially collimated" reflected cases will have a larger angular spread than exactly collimated light.

In some cases, the plurality of facets follow a base curvature that is generally parabolic. For these cases, the light source is disposed at a focus of the parabola. Although the term "parabola" is a two-dimensional curve, rather than a three-dimensional surface, it will be understood that that any surface of rotation that has a parabolic cross-section (such as a paraboloid) may be described herein by the terms "parabola" and "parabolic".

In some cases, light reflected off a particular facet has a relatively small range of propagation angles. In contrast, light emerging from the LED array has a relatively large range of propagation angles.

In some cases, the facets in the plurality are arranged to fill a two-dimensional area of the rear lamp reflector.

In some cases, the facets in the plurality are arranged rectangularly in rows and columns.

In some of these cases, the number of rows and the number of columns are both between six and twelve. The number of rows and columns may by the same or different, and each may be one, two, three, four, five, six, seven, eight, nine, ten, eleven, twelve, thirteen, fourteen, fifteen, sixteen, or more than sixteen. In some cases, there may be bilateral symmetry, where the leftmost columns minor the rightmost columns. In some cases, the tilt of each facet spreads light in the opposite direction of an adjacent facet. The spread width may be different or the same as that of the adjacent facet.

In some cases, the size of each facet is 10 mm square. In general, larger facets may not show as much sparkle effect, due to reductions in the number of lit facets and their respective increase in size. If the facets are too small, the amount of light that is lost may increase, due to minimum radii and draft wall at the facet edges. In some cases, the size may feature facets smaller than 10 mm square, with each facet covering smaller vertical and horizontal extents.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

GLOSSARY

A Non-Limiting Summary of Above Reference Numerals

1 automobile
2 front turn indicators
3 headlamps
4 fog lamps
5 headlamp cleaning system
6 side repeaters
7 center high mounted stop lamp
8 license plate lamp
9 rear combination lamp
10 rear combination lamp
11 LED module
12 diverging beam
13 reflector
14 generally collimated beam
15 clear cover
16 generally collimated beam
16A, 16B, 16C output beams from rear combination lamp
17A, 17B, 17C light distributions from rear combination lamp
19, 19A, 19B, 19C, 19D, 19E facets of rear combination lamp
20 housing
21 heat sink
22 tab
23 holes in heat sink
24 fins on heat sink
31 thermal pad
32 tab
33 holes in thermal pad
41 printed circuit board
42 slot
43 electrical connectors
44A, 44B, 44C light emitting diodes
51 adapter
60 two-dimensional light distribution
110 rear combination lamp
116A, 116B, 116C output beams from rear combination lamp

117A, 117B, 117C light distributions from rear combination lamp

119 regions of reflector in rear combination lamp

191, 192, 193 subsets of facets of rear combination lamp

What is claimed is:

1. A rear lamp reflector of a vehicle, comprising:

a plurality of reflective facets (19) that reflect light (12) emitted by alight source (11) toward a viewer, the reflected light (16) being viewable over a range of viewing angles from the vehicle angles;

wherein the facets (19) are angled so that at first and second viewing angles, light (16) propagates to the viewer only from respective first and second subsets (191, 192) of facets (19) from the plurality;

wherein at least two of the facets in the first subset (191) are non-contiguous;

wherein at least two of the facets in the second subset (192) are non-contiguous; and wherein the first and second subsets (191, 192) are mutually exclusive, whereby at least one facet from the second subset (192) is disposed between said at least two of the facets in the first subset (191), and at least one facet from the first subset (191) is disposed between said at least two of the facets in the second subset (192).

2. The rear lamp reflector of claim 1, wherein as the viewing angle changes, light arrives at the viewer from a changing subset of facets (19) from the plurality, at least two facets at a time.

3. The rear lamp reflector of claim 2, wherein as the changing subset changes, the facets in the changing subset visually appear to change in a non-repeating visual pattern.

4. The rear lamp reflector of claim 2, wherein as the changing subset changes, the facets in the subset visually appear to change in a pattern.

5. The rear lamp reflector of claim 4, wherein the pattern includes alternating facets in both horizontal and vertical dimensions.

6. The rear lamp reflector of claim 1, wherein each facet is concave and is curved to collimate the light emitted by the light source.

7. The rear lamp reflector of claim 1, wherein each facet is concave and is curved to partially collimate the light emitted by the light source.

8. The rear lamp reflector of claim 1, wherein the plurality of facets follow a base curvature that is generally parabolic; and wherein the light source is disposed at a focus of the parabola.

9. The rear lamp reflector of claim 1, wherein the facets in the plurality are arranged to fill a two-dimensional area of the rear lamp reflector.

10. The rear lamp reflector of claim 1, wherein the facets in the plurality are arranged rectangularly in rows and columns.

11. The rear lamp reflector of claim 10, wherein the number of rows and the number of columns are both between six and twelve.

12. The rear lamp reflector of claim 1, wherein the collective facets at least generally collimate the light emitted by the light source.

13. The rear lamp reflector of claim 1, wherein the reflector comprises an outwardly-directed exterior reflector surface defined collectively by said plurality of reflective facets (19), said exterior reflector surface generally facing the light source (11) and receiving light emitted by the light source (11) such that reflection off the facets (19) forms the reflected light (16).

14. The rear lamp reflector of claim 1, wherein a surface of the reflector comprises non-light transmissive material.

* * * * *